United States Patent [19]

Misu

[11] Patent Number: 4,734,055

[45] Date of Patent: Mar. 29, 1988

[54] CORD BUSHING

[75] Inventor: Hisataka Misu, Osaka, Japan

[73] Assignee: Kitagawa Industries Co., Ltd., Aichi, Japan

[21] Appl. No.: 335,924

[22] Filed: Dec. 30, 1981

[51] Int. Cl.[4] ..... H01R 13/58

[52] U.S. Cl. ..... 439/456; 29/854; 174/1536

[58] Field of Search ..... 339/103 B, 105, 107; 174/1536; 439/449, 456, 460; 29/854

[56] References Cited

U.S. PATENT DOCUMENTS

| | | | |
|---|---|---|---|
| 2,724,736 | 11/1955 | Klumpp | 174/153 |
| 3,502,917 | 3/1970 | Bizoe | 174/153 G X |
| 3,749,818 | 7/1983 | Jemison | 174/153 G |

FOREIGN PATENT DOCUMENTS

| | | | |
|---|---|---|---|
| 2903954 | 8/1980 | Fed. Rep. of Germany | 339/105 |
| 53-74092 | 6/1978 | Japan . | |
| 53-137699 | 10/1978 | Japan . | |

*Primary Examiner*—Eugene F. Desmond

*Attorney, Agent, or Firm*—Griffin, Branigan, & Butler

[57] ABSTRACT

A cord bushing includes a lid portion (2) hingedly connected to mate with an electrical terminal-retaining portion (1). The lid portion (2) has hingedly connected thereto retaining means (24) adapted to bear against a cord when the lid portion (2) mates with the terminal-retaining portion (1). A cord protector (6) is orthogonally oriented with respect to portions (1,2) so that the protector (6) extends parallel to the side of an appliance into which the bushing is inserted.

13 Claims, 7 Drawing Figures

CORD BUSHING

BACKGROUND

The present invention pertains to cord bushings, and particularly to cord bushings utilized with electrical devices or apparatus such as electrical appliances or the like.

A bushing is usually provided to protect an electric cord as the cord passes through an opening in an outer casing of an electrical apparatus. Prior art bushings typically have internal projections and recesses provided in a bore or cavity thereof which cooperate to bear against the cord and bend the cord so that it is held in position within the bushing.

In Japanese utility model patent application laid-open No. 53(1978)-137699 applicant has disclosed a cord bushing which includes a bendable cord protector. The bendable protector comprises a plurality of linked rings through which the cord extends. The bendable cord protector allows the cord to gently bend either right and left or up and down in such a manner that the cord is not in danger of being severed.

Most electrical devices nowdays have connecting electrical terminals provided in the opening in the outer casing of the electrical device, rather than have the cord continue internally past the openings and into the electrical device. To this end, applicant has disclosed in Japanese utility model patent application laid-open No. 53(1978)-74092 a cord bushing having both the bendable cord protector described above and electrical terminals connected to an end of the electrical cord. The cord bushing disclosed in application 53(1978)-74092 comprises two distinct mating members which are not connected in their unmated configuration. The first member is provided at one end thereof with a recess into which the second member securely fits. The second member is adapted to receive therein electrical terminals formed at the end of the electrical cord passing through the bushing. When the first and second members mate, projections and recess provided on interior portions of the members press against the cord to hold the cord into position so that the cord will not come out of the bushing.

Applicant has found it somewhat awkward to assemble the cord bushing device described immediately above, inasmuch as the electrical terminals must be placed in the second member while the second member is separated from the first member through which the cord extends. The projections provided in both the first member and the second member complicate the mating assemblage in a situation where the second member receives the electrical terminal while the first member has the cord passing therethrough. Moreover, although both first and second members are fabricated with a plastic injection molding process, the second member cannot be fabricated in a single step since it has a internal configuration (comprising a curved projecting surface) which prohibits the withdrawal of a mandrel-like pin member used during the plastic injection molding process.

Prior art cord bushings having cord-protecting structures mounted essentially perpendicularly with respect to the side of the electrical device from which they extend. Thus, a space approximating the length of the cord-protecting structure must be allowed between the outer casing of the apparatus and a nearby wall or floor to accommodate the cord-protecting structure. That is, since a cord-protecting structure usually extends perpendicularly out of a side of an outer casing of an electrical appliance such as a toaster, a stove, or the like, the applicance cannot necessarily be placed close to a wall or floor since sufficient room must be allowed between the appliance and the wall for the cord-protecting structure.

In view of the foregoing, an object of this invention is the provision of easily fabricated and easily assembled cord bushing.

An advantage of this invention is the provision of an essentially L-shapped cord bushing wherein cord-protecting structure does not extend essentially perpendicularly to the sides of the outer casing of an electrical device.

Another advantage of this invention is the provision of a cord bushing having resiliently hinged cord retaining means which bears against a cord passing through the cord bushing and enables the cord to exert pressure against an opening in an appliance casing through which the bushing is inserted.

SUMMARY OF THE INVENTION

A cord bushing includes a lid portion hingedly connected by a flexible hinge to an electrical retaining portion of the bushing with which the lid mates. The lid portion of the bushing has hingedly connected thereto by another flexible hinge a flap which serves both as a means to retain a cord in the mated bushing and as a means to retain the mated bushing in an opening in the outer casing of an apparatus into which the cord bushing is inserted.

The terminal-retaining portion of the cord bushing has a cavity therein which accommodates a portion of the electrical cord. The cavity is partitioned to define two terminal-receiving channels. Retaining means extend into the channels so that the electrical terminals are securely positionable therein. Thus, the terminal-retaining portion of the cord bushing serves both to accommodate the electrical cord and to retain the electrical terminals connected to an end of the cord, so that the lid portion may conveniently mate with the terminal-receiving portion of the bushing.

The cord bushing has a recessed groove provided therearound which facilitates insertion of the cord bushing into an opening in an apparatus outer casing. A portion of the recessed groove is provided on the flexibly hinged retaining means.

A cord protector extends essentially orthagonally from a main member of the cord bushing to permit the appliance through which the bushing is inserted to be placed in closer proximity to walls or the like. The cord protector extends essentially parallel to the outer casing of the appliance.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating principles of the invention.

DETAILED DESCRIPTION OF THE DRAWINGS

Figure 1:
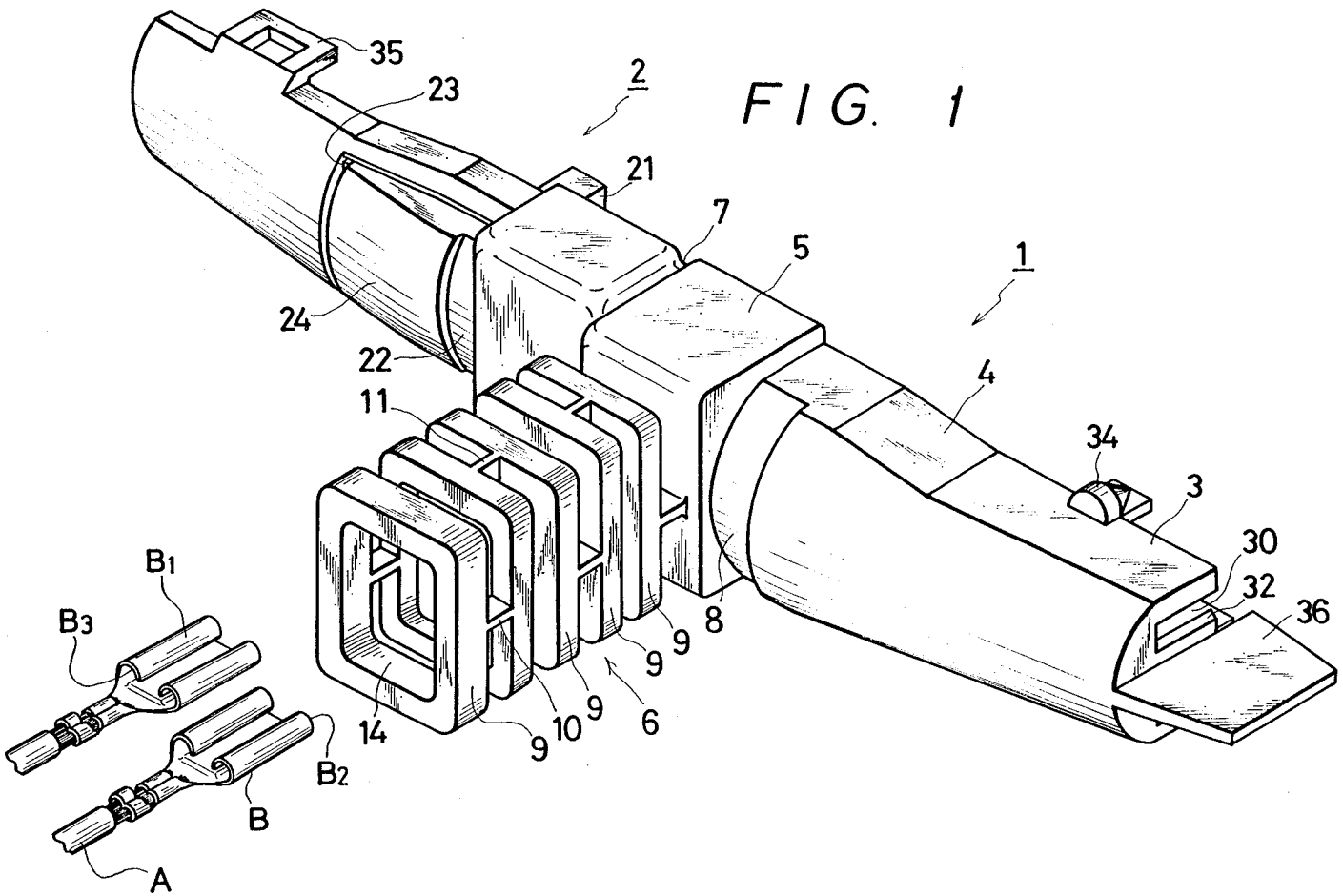
FIG. 1 is a perspective view of an unassembled bushing according to an embodiment of the invention.
Figure 2:
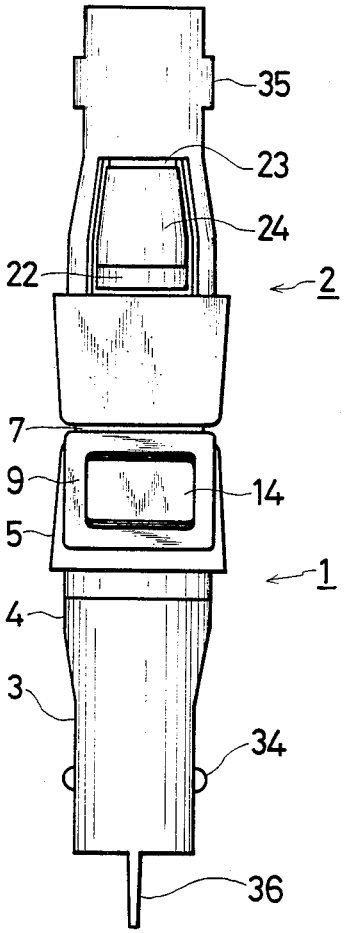
FIG. 2 is a left side view of FIG. 1.
Figure 3:
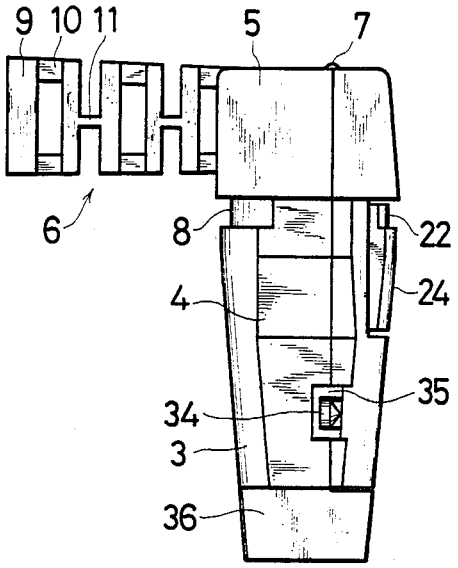
FIG. 3 is a front view of the cord bushing of FIG. 1
Figure 4:
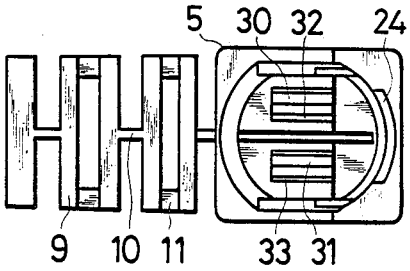
FIG. 4 is a bottom of FIG. 3.
Figure 5:
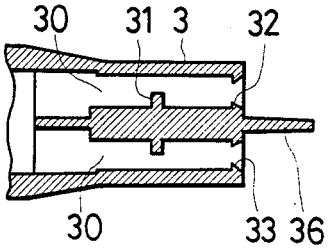
FIG. 5 is a sectional view of a portion of the cord bushing of FIG. 4.
Figure 6:
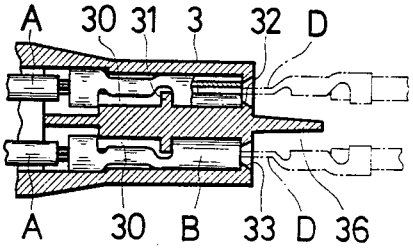
FIG. 6 is a sectional view of a portion of a cord bushing of FIG. 4 but also showing terminals mounted therein.

As seen in FIG. 1, a cord bushing of the present invention includes a main member comprising a terminal-retaining portion 1 and a lid portion 2. The cord bushing of FIG. 1 is essentially L-shaped and further includes a connector portion 3; a head portion 4; a central portion 5; and, a protector 6. A flexible, bendable hinge 7 is provided to link the portion 1 and the lid portion 2. A neck 8 proximate the central portion 5 is recessed so that the cord bushing may be inserted in an opening $C_1$ provided on an outer casing of an electrical apparatus. The head portion 4 has a cavity or recess 12 provided therein to accommodate the cord. The central portion 5 also has a cavity 13 therein to accommodate the cord.

The protector 6 prevents the cord from bending excessively. The protector 6 has several cord-surrounding members, such as rings 9, which line up in parallel to form a row. Rings 9 are united with each other by first link members 10 and second link members 11. First and second rings 9 are united by a pair of links 11; second and third rings by a pair of links 10; third and fourth rings by a pair of links 11; and so on. The links of each pair are positioned at opposite points on each ring 9 with respect to the cord passing through a passage or opening 14 in each ring 9. Links 10 are spaced 180° apart from each other but are positioned at 90° intervals with respect to links 11.

The first link members 10 allow the cord to bend gently up or down while the second link members 11 assist to permit the cord to bend gently right or left. Consequently, the protector 6 enables the cord to bend gently in any direction. Thus, the maximum extent of bending of the cord is limited by the protector 6. The protector 6 does not allow the cord to bend excessively and hence severance of the cord is prevented.

The lid portion 2 is linked with the portion 1 by the flexible hinge 7. When the portions 1 and 2 are mated, a grooved recess 22 provided on the exterior (outer) face of the lid portion 2 together with the recessed neck 8 on the portion 1 cooperate to form an essentially ring-shaped groove which is adapted to engage the opening $C_1$ provided on the casing of the apparatus.

A projection 21 is provided on an end of a retaining means, such as flap 24, to press the cord in the recess 12 and to retain the same in position. The retaining means 24 is connected by a flexible, hinge-like joint portion 23 to the lid portion 2. Thus, the flap 24 is allowed to move up and down with the joint portion 23 functioning as a pivot.

The connector portion 3 of the portion 1 serves to retain the electrical terminal of the cord in position. A partitioning means in the interior of the connector 3 defines two grooves or channels 30 running longitudinally parallel with each other. The two grooves 30,33 receive two separated terminals which are connected to an end portion of the cord. The grooves 30,30 have extending therein (from said partitioning means) terminal retaining means, such as lugs 31,31. Terminal stopping means, such as first stoppers 32,32 and second stoppers 33,33 are provided to constrict the opening of channels 30,30 at their intersection with the exterior of the connector 3 and function with lugs 31 to retain the terminals in the channels 30. In this regard, lugs 31 hold a rearward end $B_3$ of the terminal B and the first and second stoppers 32 and 33 hold a forward end $B_2$.

The connector 3 has locking means, such as lugs 34,34 provided on its outer side surfaces. The lugs 34,34 engage companion locking elements (square rings 35,35 respectively) to tightly hold the portion 1 and the lid portion 2 together in mating relationship.

For the embodiment illustrated in the accompanying drawings wherein female terminals B,B are provided to receive male terminals D,D insertable therein, an insulating plate 36 is provided at a forward end of the connector 3. The plate 36 is placed between the terminals D,D to isolate one terminal D from the other terminal D.

A method of mounting (assembling and installing) the bushing of the present invention will now be explained.

The cord A is denuded at a forward end portion thereof and the terminals B,B are connected to the exposed end portions of the cord A in the conventional manner. The cord A, capped with the terminals B,B, is passed throught the bore 14 of the protector 6 and then is pulled through the cavity 13 of the central portion 5 so that a length or cord extends linearly beyond the central portion 5. Next, the cord A is bent so that the terminals B,B at the forward end portion thereof can be buried in the grooves 30,30 on the connector 3.

In the above regard, in burying the terminals B,B in grooves 30,30, each terminal B is held by the first and second stoppers 32 and 33 at the forward terminal end $B_2$ and also by the first lug 31 at the rearward terminal end $B_3$. Thus, both terminals B,B are held firmly in the connector portion 3 of the terminal-retaining portion 1.

Next, the lid portion 2 (connected with the portion 1 by the hinge 7) is bent with the hinge 7 functioning as a pivot. The square rings 35,35 on the lid portion 2 engage the second lugs 34,34 on the portion 1 to hold together the main portion 1 and the lid portion 2. Thus, the terminals B,B are retained in position firmly and are not allowed to move right and left nor forwardly and backwardly. Should need arise to unmate portions 1 and 2, square rings 35,35 can be selectively snapped out of or into engagement with lugs 34,34.

The projection 21 mounted on the flap 24 presses the cord A in the recess and retains the cord in position. Since the hinged joint portion 23 is recessed and thin, the flap 24 is pushed outwardly (away from the cord) by a force of restitution exerted by the cord A and is bent with the joint portion 23 being a pivot, Consequently, the recess 22 may be raised a small amount.

Figure 7:
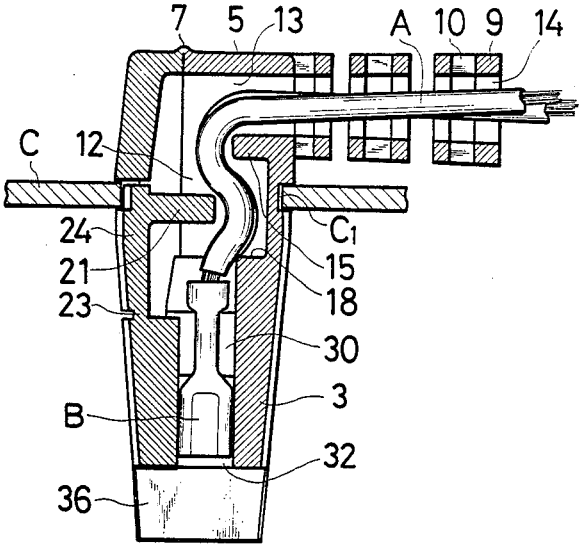
FIG. 7 is a sectional view of a cord bushing according to an embodiment of the invention as installed.

Lastly, the connector 3 is inserted into the opening $C_1$ of the outer casing C of the electric apparatus. The recessed neck 8 and the recess 22 engage with the opening $C_1$. The cord A is pressed as shown in FIG. 7 in opposite directions concurrently by the projection 15, a shoulder 18, and the projection 21 and is retained firmly in the cord bushing.

Since the projection 21 is pushed outwardly by the elasticity of the cord A, the flap 24 is forced to bend outwardly so that the bushing is held and retained firmly in pressed relation in the opening $C_1$.

In the embodiments illustrated, the cord bushing is fabricated to accommodate a female terminal B. It should be evident to one skilled in the art that other embodiments of cord bushings accommodating male terminals therein may be fabricated since both terminals are known and widely used.

The lugs 34,34 provided on the portion 1 and the square rings 35,35 on the lid portion 2 are just one form of locking means suitable for use with the cord bushing. In another embodiment the second lug 34 is mounted on the lid portion 2 and the square ring 35 is mounted on the portion 1.

The cord bushing of this invention is manufactured in monobloc casting by plastic injection molding. In this regard, since the bushing is suitably shaped internally, an internal molding member (pin) is easily pulled out after molding. Consequently, the cord bushing is manufactured with ease and at low cost.

The cord bushing is made from hard plastics, preferably Nylon or the like.

The cross-sectional shapes of the main member 1 and the protector 6 are essentially square in the illustrated embodiments. These shapes are not critical but could take on other configurations, such as a cylindrical shape, for example.

As described above, mounting the terminals B,B on the connector 3 is quite easy. It is also easy to install the bushing in the opening $C_1$. This naturally assists assembling of the electric apparatus.

Since the protector 6 is placed in an essentially parallel relationship to the face of the outer casing of the electric apparatus, extra space between an appliance and the wall or floor is not required.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A cord bushing comprising:

a main member having a first main member portion adapted to accommodate a portion of a cord and to retain terminals connected to said cord;

a second main member portion, said second main member portion being hingedly connected to said first main member portion to mate with said first main member portion;

wherein exterior portions of said first main member portion and said second main member portion each have recessed grooves thereon whereby said main member may be retained in an opening in an apparatus into which said cord bushing is inserted when said first and second main member portions are mated;

wherein said second main member portion comprises retaining means hingedly connected to said second main member portion, whereby said retaining means pivots inwardly about said hinge to bear against said cord as said mated main member portions are being inserted into said opening in said apparatus, and wherein said retaining means has a portion of said recessed groove provided thereon, whereby said cord causes said retaining means to pivot outwardly and bear against said apparatus opening when said groove is aligned with said apparatus opening; and, cord protection means through which said cord extends, said cord protection means comprising a plurality of spaced apart, cord-surrounding members arranged to form a passage through which said cord extends, each of said cord-surrounding members being connected to an adjacent cord-surrounding member by linking members, said linking members being positioned at opposite points on each cord-surrounding member with respect to said cord extending therethrough.

2. The cord bushing of claim 1, wherein said cord-surrounding members and said linking members of said cord protection means are comprised of plastic.

3. A cord bushing comprising:

a first main member portion adapted to accommodate a portion of a cord and to retain terminals connected to said cord;

a second main member portion hingedly connected to said first main member portion to permit said second main member portion to mate with said first main member portion; and, retaining means included on said second main member portion and hingedly connected thereto by a resilient hinge, whereby when said first main member portion mates with said second main member portion, said retaining means first bears against said cord and then resiliently pivots outwardly from said cord about said hinge.

4. The cord bushing of claim 3, wherein an exterior portion of said retaining means has a recesed groove provided thereon, so that after said retaining means pivots inwardly to bear against said cord as said mated main member portions are being inserted into a bushing-receiving opening in an apparatus, said cord causes said retaining means to pivot outwardly and bear against said apparatus opening when said groove is aligned with said apparatus opening.

5. The cord bushing of claim 4, further comprising cord protection means through which said cord extends, said cord protection means being essentially orthogontally oriented with respect to said main member.

6. The cord bushing of claims 1 or 3, wherein said first main member portion and said second main member portion are provided with locking means to lock said portions in mating relationship.

7. The cord bushing of claims 1 or 3, wherein said main member and said cord protection means are comprised of plastic.

8. The cord bushing of claims 1 or 3, wherein said first main member portion has a cavity wherein said cord is accommodated, wherein cavity partitioning means is formed integral with said first main member portion to divide a portion of said cavity into two terminal-receiving channels, and wherein terminal retaining means partially extend into each of said terminal-receiving channels to retain said terminals in position in said channels.

9. The cord bushing of claims 8, wherein said terminals are female terminals.

10. The cord bushing of claim 8, wherein said terminals are male terminals.

11. The cord bushing of claim 8, wherein said terminal retaining means comprise projections integral with said cavity partitioning means, said projections oriented to extend into said channels and retain said terminals therebetween.

12. The cord bushing of claim 11, wherein said first main member portion has at least one projection formed thereon to bear in a first direction against said cord accommodated in said first main member, and wherein said retaining means of said second main member portion comprises a projection adapted to bear against said cord in a second direction opposite said first direction when said first main member portion and said second main member portion mate.

13. A method of inserting and retaining an end of an electrical cord into a cord bushing, said end of the electrical cord having electrical terminals provided thereon, said method comprising the steps of:

inserting said terminals connected to said cord through a passage formed in cord protection means, said cord protection means extending essentially orthogonally from a main member of said bushing;

passing said terminals connected to said cord through an aperture in a terminal-receiving portion of said main member of said bushing;

pulling a length of cord through said aperture in a direction essentially orthogonal to said main member of said bushing;

bending said cord beginning at a point near said aperture so that said terminals on one end of said cord lie in terminal-receiving channels in said terminal-receiving portion of said cord bushing, with the result that said end of said cord connected to said terminals is oriented essentially orthogonally to a portion of said cord entering said passage in said cord protection means;

securing said terminals between retaining means provided in said terminal-receiving channels; and, enclosing said terminals in said main member by mating said terminal-receiving portion of said main member with a lid portion of said main member, said lid portion of said main member being hingedly connected to said terminal receiving portion thereof.

* * * * *